US006857410B2

(12) United States Patent
Davis et al.

(10) Patent No.: US 6,857,410 B2
(45) Date of Patent: Feb. 22, 2005

(54) ENGINE CONTROL SYSTEM

(76) Inventors: Steven T. Davis, 2790 Helsinki Rd., Green Bay, WI (US) 54311; Gary Stanelle, 137 E. Rees St., Fond du Lac, WI (US) 54935

( * ) Notice: Subject to any disclaimer, the term of this patent is extended or adjusted under 35 U.S.C. 154(b) by 0 days.

(21) Appl. No.: 10/409,202

(22) Filed: Apr. 8, 2003

(65) Prior Publication Data

US 2004/0025811 A1 Feb. 12, 2004

Related U.S. Application Data

(60) Provisional application No. 60/402,841, filed on Aug. 12, 2002.

(51) Int. Cl.[7] ..... F02F 7/00
(52) U.S. Cl. ..... 123/195 R
(58) Field of Search ..... 123/195 R, 41.7, 123/400, 198 E, 179.1, 196 W

(56) References Cited

U.S. PATENT DOCUMENTS

| | | | | |
|---|---|---|---|---|
| 2,908,263 A | | 10/1959 | Brown | |
| 3,823,700 A | | 7/1974 | Gumtow | |
| 4,674,146 A | * | 6/1987 | Tuggle et al. | 15/330 |
| 4,811,705 A | * | 3/1989 | Ono et al. | 123/195 AC |
| 5,174,255 A | | 12/1992 | Collins et al. | |
| 5,421,297 A | | 6/1995 | Tamba et al. | |
| 5,720,250 A | | 2/1998 | Greppmair et al. | |
| 6,116,581 A | | 9/2000 | Watanabe et al. | |
| 6,135,428 A | | 10/2000 | Schliemann et al. | |
| 6,378,468 B1 | | 4/2002 | Kouchi et al. | |

FOREIGN PATENT DOCUMENTS

| | | |
|---|---|---|
| DE | 196 18 699 | 11/1997 |
| DE | 198 44 170 | 3/2000 |
| JP | 02-033415 | 2/1990 |
| JP | 10-077860 | 3/1998 |

* cited by examiner

*Primary Examiner*—Tony M. Argenbright
*Assistant Examiner*—Hyder Ali
(74) *Attorney, Agent, or Firm*—Baker & Daniels

(57) ABSTRACT

A small internal combustion engine having user interfaces which are located proximate to one another and within a centralized portion of the engine which is easily accessible by a user, such that the user may readily identify and manipulate the user interfaces. The user interfaces include the carburetor choke and throttle controls, the carburetor primer bulb, the engine ignition key switch, the fuel shut-off valve, the fuel fill inlet and fuel tank cap, and the oil fill inlet and oil fill cap. The carburetor choke and throttle controls are configured as rotary members mounted within an upper front portion of the engine shroud, and are shaped for easy grasping by a user to control the running of the engine.

21 Claims, 9 Drawing Sheets

ENGINE CONTROL SYSTEM

CROSS REFERENCE TO RELATED APPLICATIONS

This application claims the benefit under Title 35, U.S.C. § 119(e) of U.S. Provisional Patent Application Ser. No. 60/402,841, entitled INTERNAL COMBUSTION ENGINE, filed on Aug. 12, 2002.

BACKGROUND OF THE INVENTION

1. Field of the Invention

The present invention relates to small internal combustion engines of the type typically used with lawnmowers, lawn and garden tractors, small sport vehicles, or other small working implements. In particular, the present invention relates to the positioning and operation of the engine controls and other user interface components of such engines.

2. Description of the Related Art

Small internal combustion engines are typically configured as horizontal crankshaft engines or vertical crankshaft engines. Horizontal crankshaft engines are often used in applications such as snow throwers and generators, for example, while vertical crankshaft engines are often used in applications such as walk-behind lawnmowers and lawn and garden tractors, for example, although the foregoing usage may vary. Horizontal and vertical crankshaft engines typically include one or two engine cylinders, and have drive trains configured as L-head/side valve type, overhead valve ("OHV") type, and overhead cam ("OHC") type.

Additionally, small internal combustion engines typically include a number of user interfaces which are manipulated by a user of the engine in order to operate, maintain, and service the engine. These user interfaces include engine controls for starting, stopping, and varying the speed of the engine. For example, in engines with carburetors, a choke control is actuated to provide an enriched air/fuel mixture to the engine to aid in starting, and a throttle control is used to regulate the amount of air/fuel mixture delivered to the engine in order to vary the engine speed. Other engine controls include ignition switches for enabling or disabling engine ignition, as well as fuel shut-off valves for opening and closing the flow of fuel from the fuel tank of the engine to the carburetor.

In addition to the engine controls, other user interfaces for small internal combustion engines include the fuel tank cap, which is removed from the fuel tank for filling fuel into the fuel tank, as well as the oil fill cap, which is removed from the oil fill conduit for filling oil into the crankcase of the engine.

The foregoing user interfaces must be accessed by a user, some more frequently than others, for operating, maintaining, and servicing the engine. However, a problem with known small engines is that these interfaces are typically distributed at various locations around the engine housing. As an example, a single cylinder horizontal shaft engine may include a fuel tank at the top and to one side of the engine, the fuel tank including the fuel tank cap; an oil fill conduit at a lower rear portion of the engine, the oil fill conduit including the oil fill cap; carburetor throttle and choke controls at a lower left portion of the engine on the front side; and a carburetor primer bulb on an upper front side of the engine, etc. Further, positioning of the user interfaces is often not consistent from engine to engine.

Problematically, positioning of the user interfaces at various locations around the engine often makes at least some of the user interfaces inconvenient for ready access by the user, and in some cases, may make it difficult for the user to locate and/or identify particular user interfaces when same need to be accessed.

Further, the carburetor throttle and choke controls for small engines are typically in the form of slide levers which tend to occupy a large amount of space at the engine surface, which space is often at a premium in small engines. The carburetor and choke controls may be located on the engine in a manner in which they are not easily and readily accessible by the user.

What is needed is a small internal combustion engine having user interfaces which are positioned and operable in a manner which is an improvement over the foregoing.

SUMMARY OF THE INVENTION

The present invention provides a small internal combustion engine having user interfaces which are located proximate to one another and within a centralized portion of the engine which is easily accessible by a user, such that the user may readily identify and operate the user interfaces as needed. The user interfaces include, for example, the carburetor choke and throttle controls, the carburetor primer bulb, the engine ignition key switch, the fuel shut-off valve, the fuel fill inlet and fuel tank cap, and the oil fill inlet and oil fill cap. The carburetor choke and throttle controls are preferably configured as rotary members mounted within an upper front portion of the engine shroud, and are shaped for easy grasping by a user to control the running of the engine.

In one embodiment, a horizontal crankshaft V-twin engine is provided. As an illustration of the positioning of the user interfaces, the engine may be conceptually divided by intersecting horizontal and vertical planes into four quadrants, including upper and lower front quadrants and upper and lower rear quadrants. A plurality of the user interfaces are conveniently positioned close to one another and generally within the upper front quadrant of the engine, which allows the user interfaces to be easily identified and accessed by a user of the engine. In particular, each of the carburetor throttle and choke controls, the carburetor primer bulb, the ignition key switch, the fuel shut-off valve, the fuel tank cap, and the oil fill cap are positioned close to one another and within an easily accessible control area which is disposed within the upper front quadrant of the engine, concentrated about the upper front portion of the engine shroud.

Additionally, the carburetor throttle and choke controls are in the form of rotary members which are mounted within an upper portion of the engine shroud. The rotary members occupy a minimum amount of space on the engine, are intuitive in operation, and are easily grasped and manipulated by a user to control the operation of the carburetor. In one embodiment, the rotary members are connected via first and second linkage sets, respectively, to the throttle valve and choke valve of the carburetor. Advantageously, the first and second linkage sets are covered by the engine shroud and the fuel tank to hide the linkage sets from view, and to protect the linkage sets from incidental contact and damage.

In one embodiment, two control members are provided for separately controlling the carburetor choke and throttle via first and second linkage sets, respectively. In another embodiment, a single control member may be provided for controlling both the carburetor choke and throttle via a third linkage set.

In one form thereof, the present invention provides an internal combustion engine having a substantially horizontally disposed crankshaft, the engine conceptually divided by intersecting horizontal and vertical planes into four quadrants, including an upper front quadrant, a lower front quadrant, an upper rear quadrant, and a lower rear quadrant, the engine including at least three user interfaces positioned substantially within the upper front quadrant.

In another form thereof, the present invention provides an internal combustion engine, including an engine housing including a crankcase; a crankshaft rotatably supported within the crankcase; a shroud connected to the engine housing, the shroud having a distal region which is spaced away from the crankshaft; and at least three user interfaces concentrated about the shroud distal region.

In a further form, the present invention provides An internal combustion engine, including an engine housing including a crankcase; a crankshaft rotatably supported within the crankcase, the crankshaft disposed substantially horizontally; a shroud connected to the engine housing; and at least one control member rotatably mounted within the shroud, the control member operatively connected to an air/fuel mixing device.

In a still further form, the present invention provides an internal combustion engine, including an engine housing including a crankcase; a crankshaft rotatably supported within the crankcase, the crankshaft disposed substantially horizontally; a shroud connected to the engine housing, the shroud defining a control region in an upper portion of the shroud which is spaced from the crankshaft; at least one engine control member rotatably mounted within the shroud in the control region.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplification set out herein illustrates a preferred embodiment of the invention, and such exemplification is not to be construed as limiting the scope of the invention any manner.

DETAILED DESCRIPTION

Figure 1:
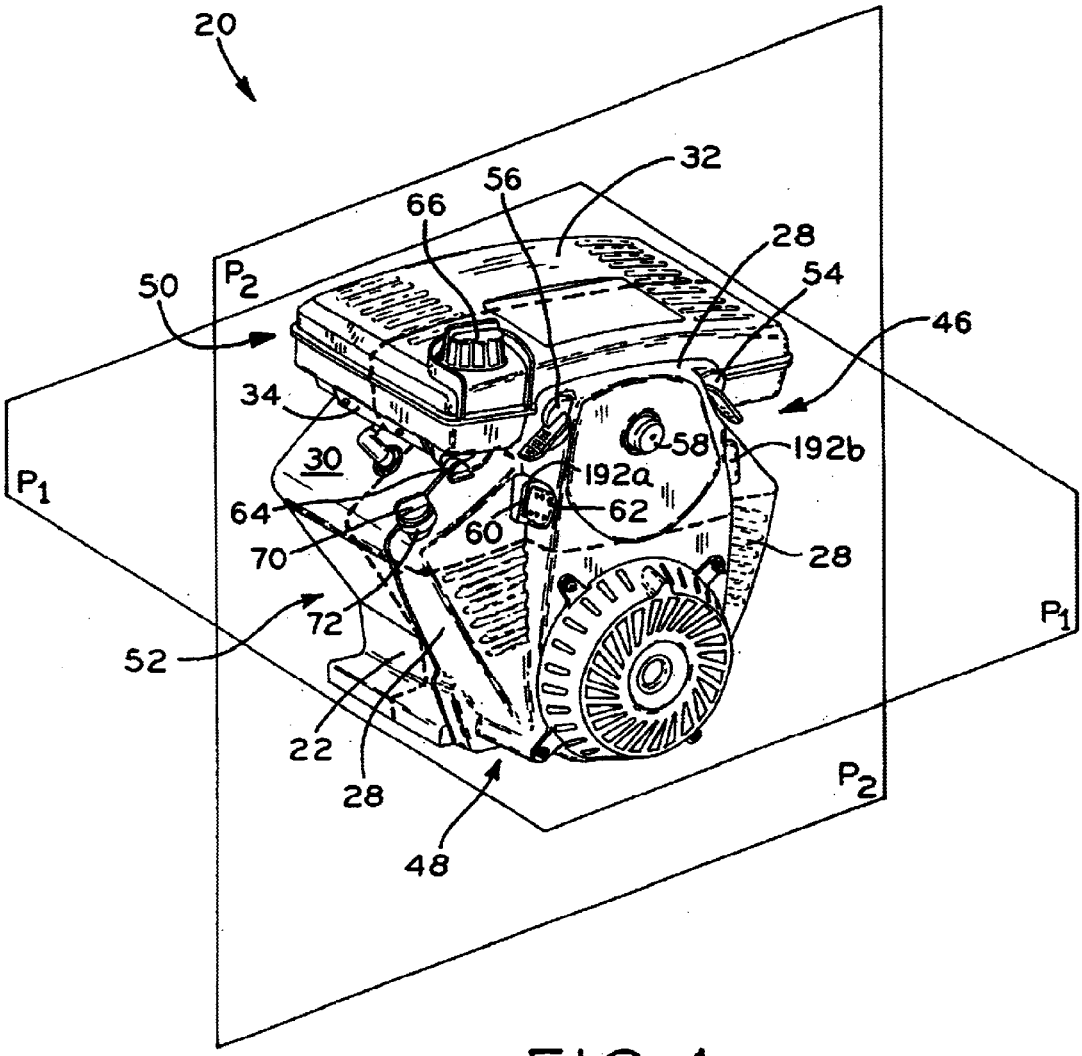
FIG. 1 is a front perspective view of a horizontal shaft, V-twin engine, including several user interfaces positioned in accordance with the present invention.

Referring to FIGS. 1–5, internal combustion engine 20 is shown herein as a horizontal crankshaft V-twin engine such as that described in detail in U.S. patent application Ser. No. 10/409,262, entitled INTERNAL COMBUSTION ENGINE, filed on Apr. 8, 2003, assigned to the assignee of the present invention, the disclosure of which is expressly incorporated herein by reference. Although engine 20 is shown as a horizontal crankshaft V-twin engine, the present invention may be embodied within any small internal combustion engine, such as vertical crankshaft V-twin engines, or horizontal or vertical crankshaft single cylinder engines. Engine 20 generally includes crankcase 22 having a pair of engine cylinders 24 (FIGS. 6–9) mounted to crankcase 22 as described in the above-incorporated U.S. patent application Ser. No. 10/409,262. A horizontally disposed crankshaft 26, shown in FIGS. 2–5, is rotatably disposed within crankcase 22, and is coupled to a pair of conventional piston/connecting rod assemblies (not shown), one corresponding to each cylinder 24.

Engine cover or shroud 28 is connected to crankcase 22 and covers at least a portion of each of crankcase 22 and cylinders 24. Cylinder wraps 30 are also connected to crankcase 22 and cylinders 24, and closely surround portions of cylinders 24 for directing cooling air around cylinders 24. Fuel tank 32 is mounted via brackets 34 to the upper ends of cylinder wraps 30.

Figure 4:
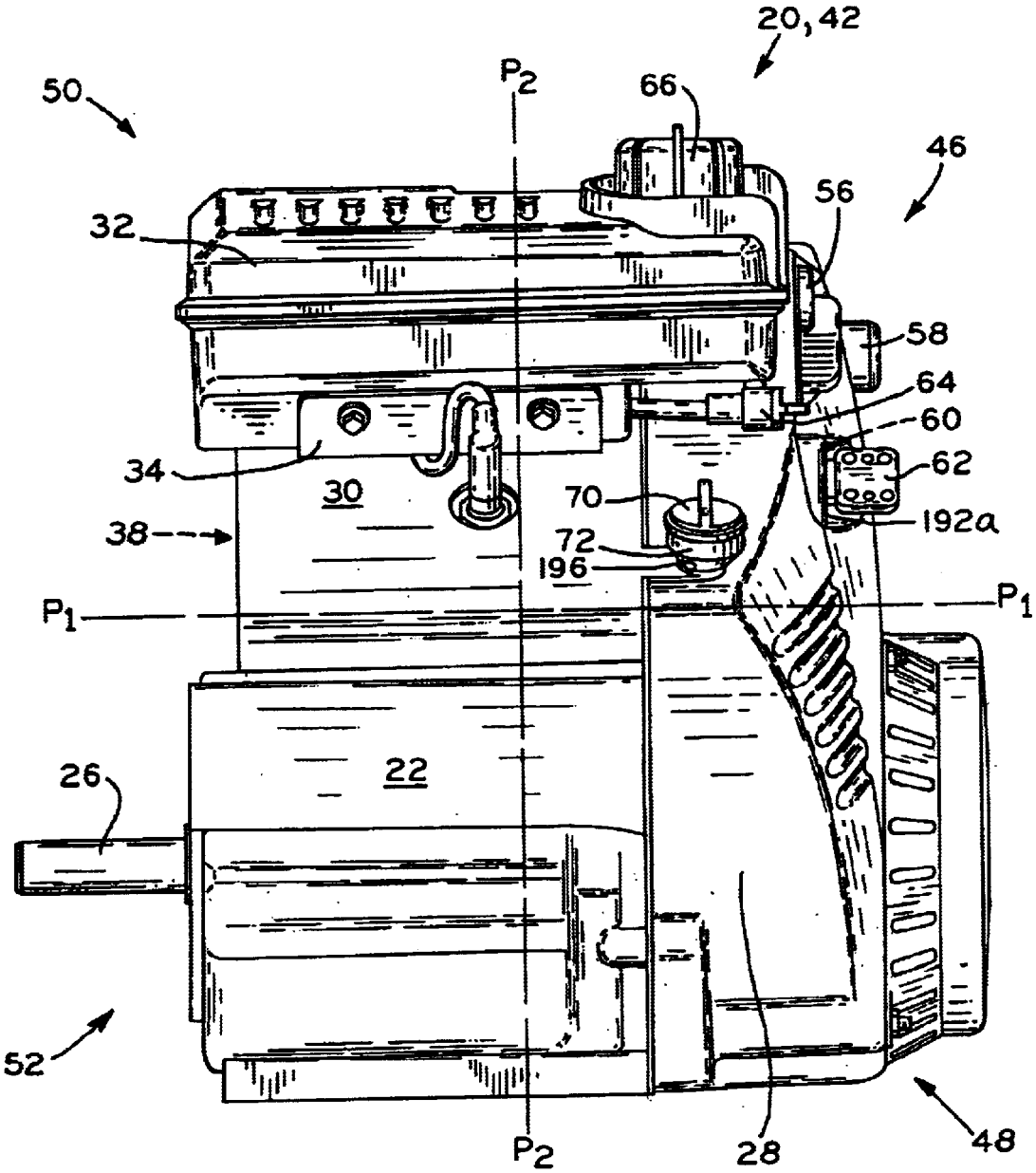
FIG. 4 is a left side view of the engine.
Figure 5:
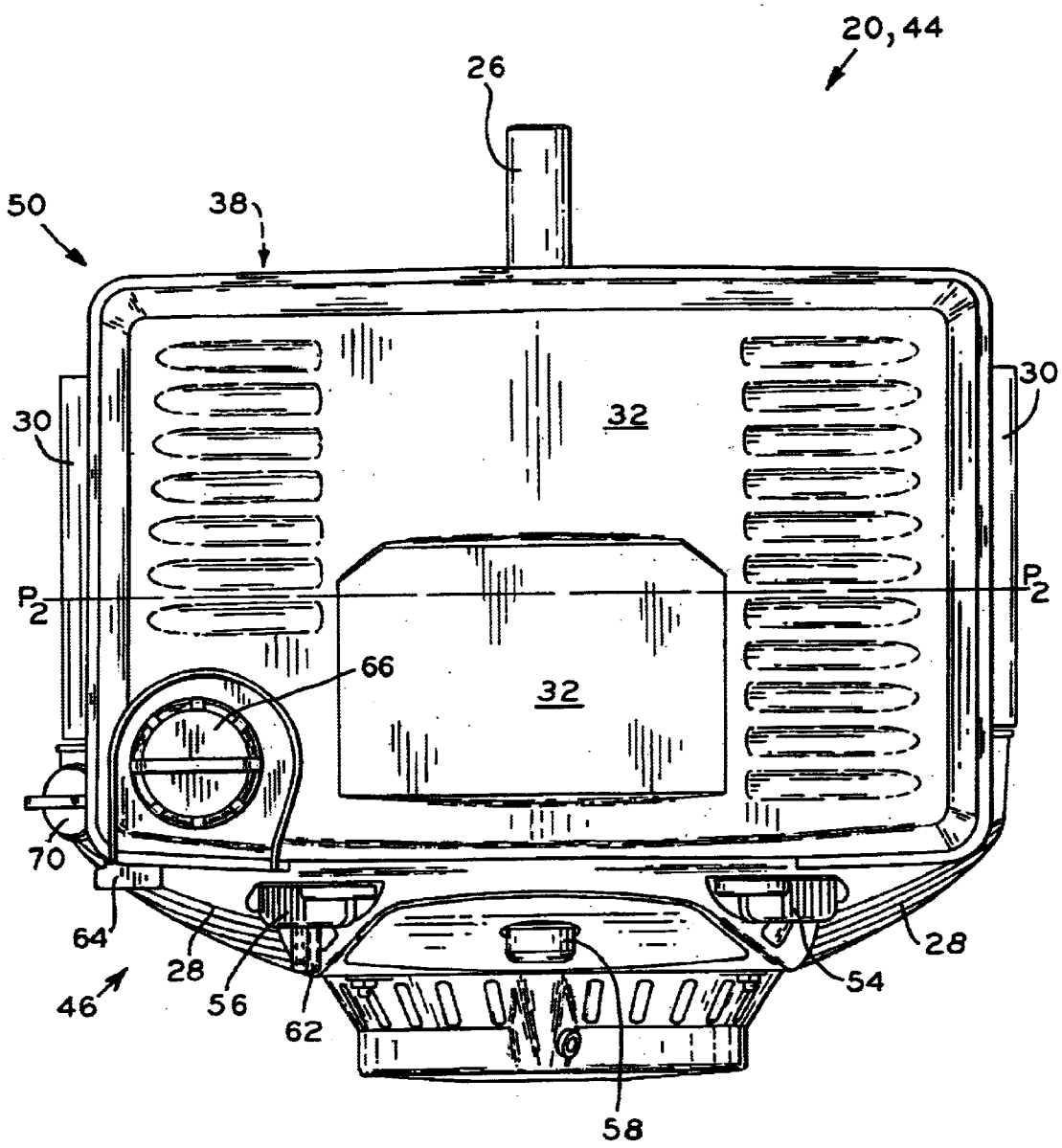
FIG. 5 is a top view of the engine.

Engine 20, as thus generally described, includes front side 36 (FIG. 2), rear side 38 (FIGS. 3–5), right side 40 (FIG. 3), left side 42 (FIG. 4), and top side 44 (FIG. 5). As shown in FIG. 1 and also in FIGS. 2–5, engine 20 may be conceptually divided by intersecting horizontal and vertical planes $P_1$—$P_1$ and $P_2$—$P_2$, respectively, wherein horizontal plane $P_1$—$P_1$ divides engine 20 between the lowermost end of engine 20 and top side 44 thereof, and vertical plane $P_2$—$P_2$ divides engine 20 between left and right sides 40 and 42 of engine 20. In this manner, engine 20 may be conceptually divided into four quadrants, namely, upper front quadrant 46, lower front quadrant 48, upper rear quadrant 50, and lower rear quadrant 52. The foregoing conceptual division of engine 20 is used herein to illustrate the advantageous positioning of the several user interfaces on engine 20; however, it should be understood that the foregoing conceptual division need not divide engine 20 into quadrants of equal size. For example, the dimensions of upper front quadrant 46, lower front quadrant 48, upper rear quadrant 50, and lower rear quadrant 52 may vary with respect to one another depending upon the overall shape or profile of engine 20.

Small internal combustion engines other than horizontal crankshaft V-twin engine 20 may also be conceptually divided in a similar manner. For example, in a vertical crankshaft V-twin engine, the upper front quadrant would encompass the same general area as upper front quadrant 46 of engine 20, including for example, the upper front portion of cylinders 24 and the upper front portion of shroud 28.

Advantageously, and as discussed in further detail below, many of the user interfaces of engine 20 are positioned substantially within upper front quadrant 46 of engine 20. Alternatively stated, many of the user interfaces of engine 20 are concentrated about a distal region shroud 28 which is spaced away from crankshaft 26, such the upper front region of shroud 28, as shown in FIGS. 1–5. In many applications, the foregoing will conveniently position the user interfaces in such a manner in which the user interfaces are readily visible, identifiable, and easily accessible to a user of the implement with which engine 20 is used. For example, when engine 20 is used in a snow thrower application, upper front quadrant 46 may face the upper rear portion of the snow thrower, such that a user who is standing directly behind the snow thrower for operating same will be able to easily access and manipulate the user interfaces which are positioned within upper front quadrant 46 of engine 20.

As used herein, the term "user interface" refers to an engine component which is operated by a user in the normal course of operating, maintaining, or servicing an internal combustion engine such as engine 20, including, for example, the carburetor choke and throttle controls, carburetor primer bulb, ignition switch, fuel shut-off valve, fuel tank inlet/cap, and oil fill inlet/cap of the engine. Specifically, as shown in FIG. 1, engine 20 includes carburetor choke and throttle controls 54 and 56, respectively, carburetor primer bulb 58, ignition key switch 60 and key 62, fuel shut-off valve 64, fuel tank cap 66 attached to the filler neck (not visible) of fuel tank 32, and oil fill cap 70 attached to oil fill conduit 72.

Figure 2:
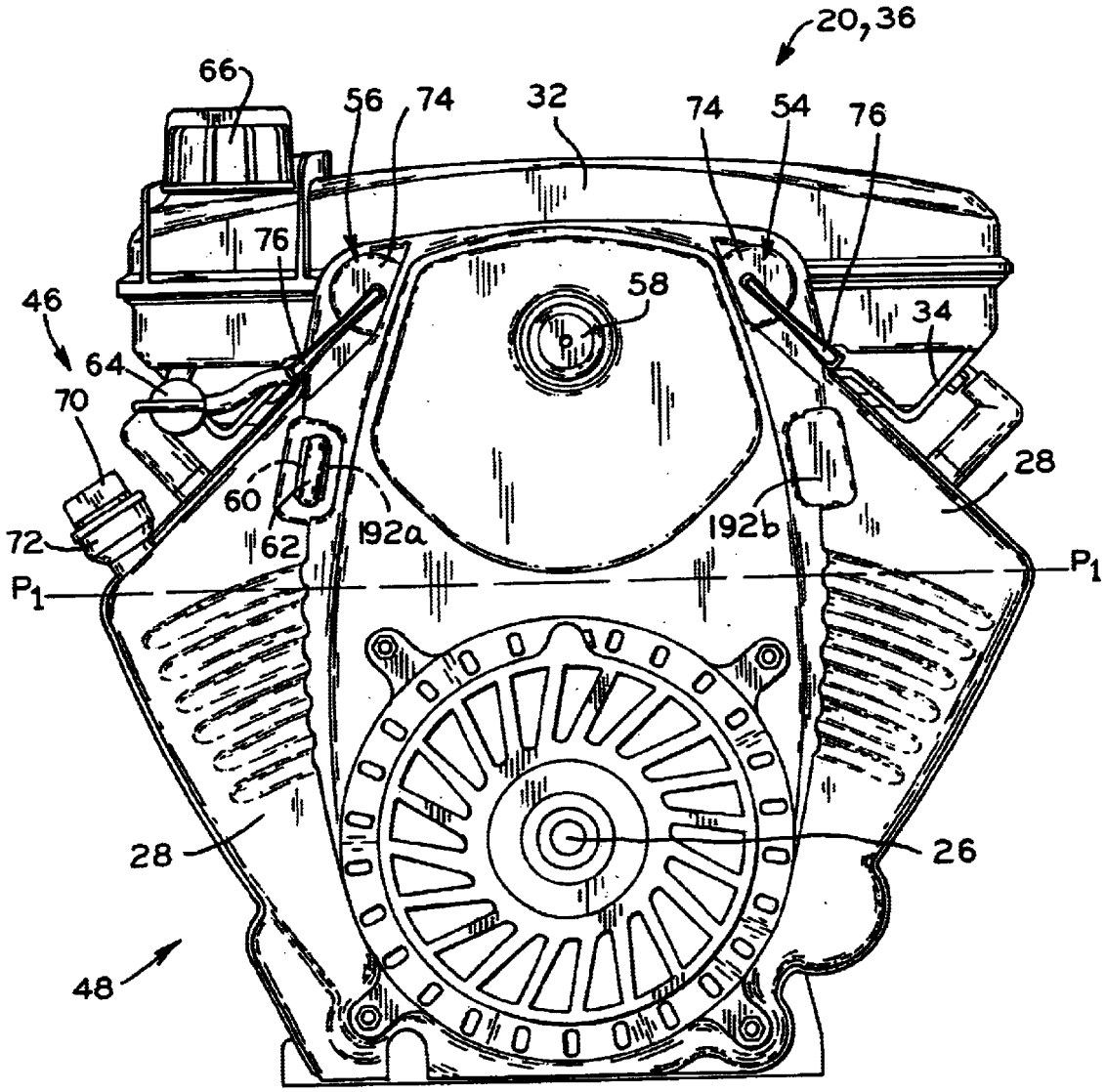
FIG. 2 is a front view of the engine.
Figure 3:
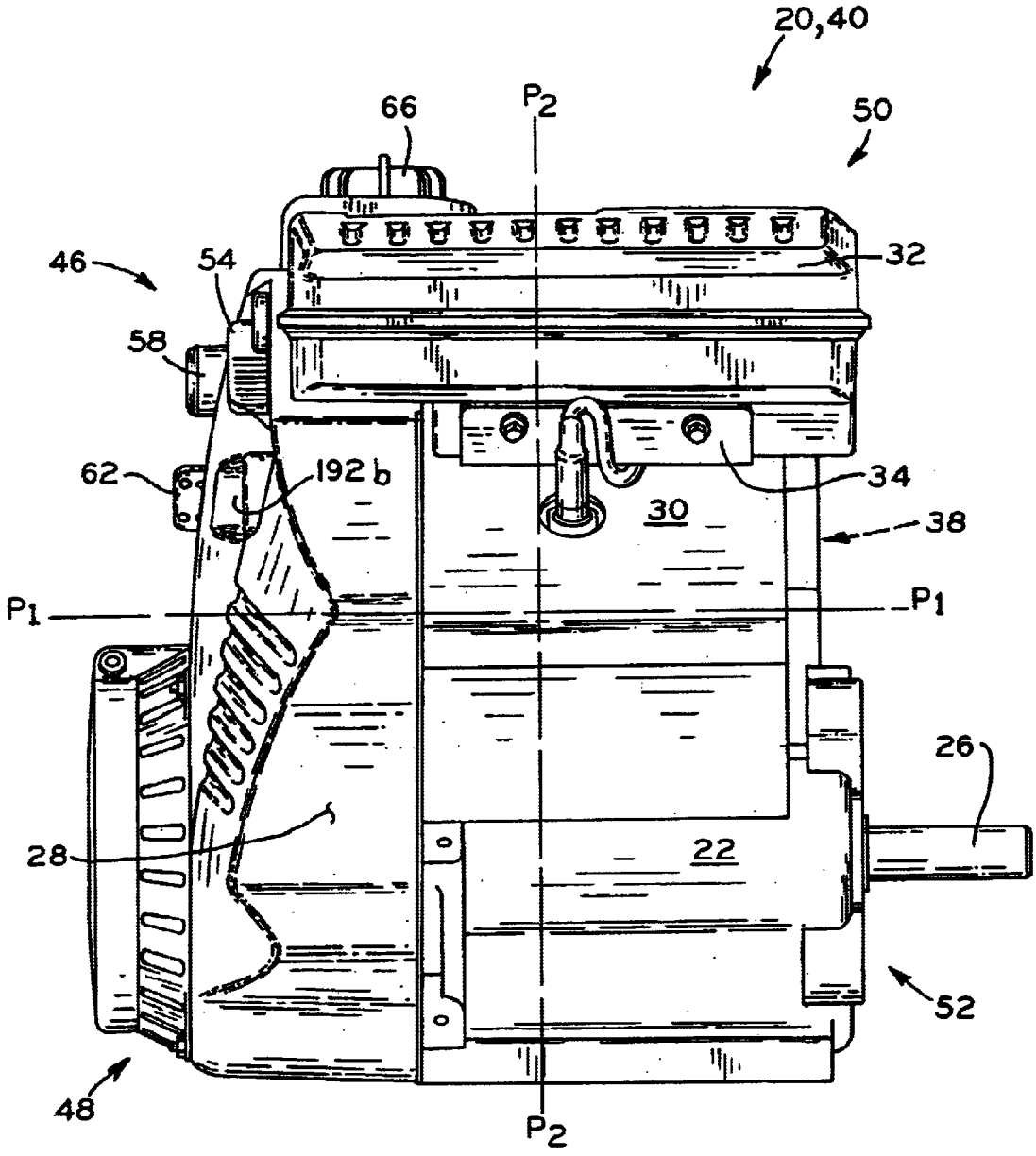
FIG. 3 is a right side view of the engine.
Figure 6:
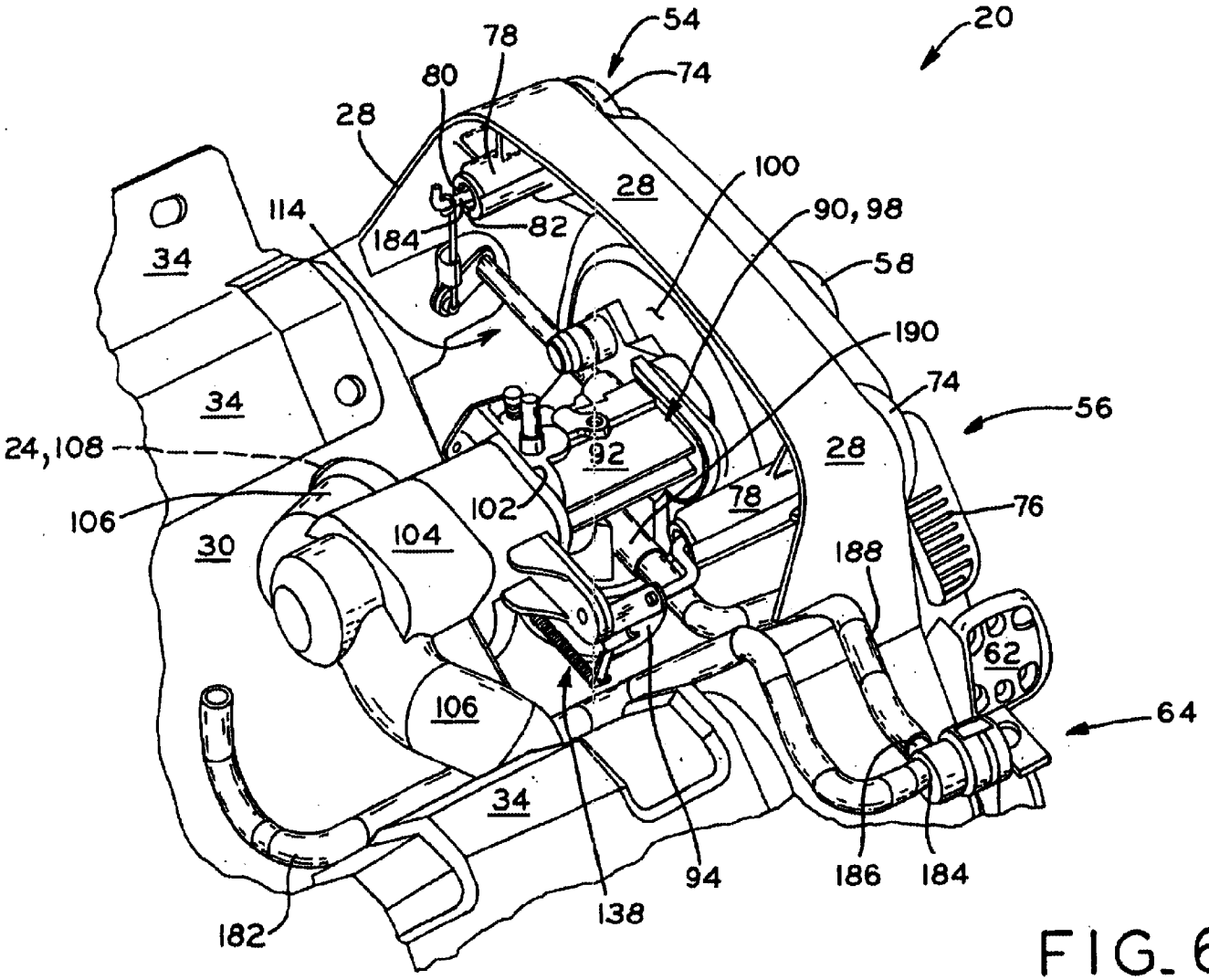
FIG. 6 is a first perspective view of an upper rear portion of the engine, showing the first and second linkage sets corresponding to the carburetor choke and throttle control members, respectively.
Figure 7:
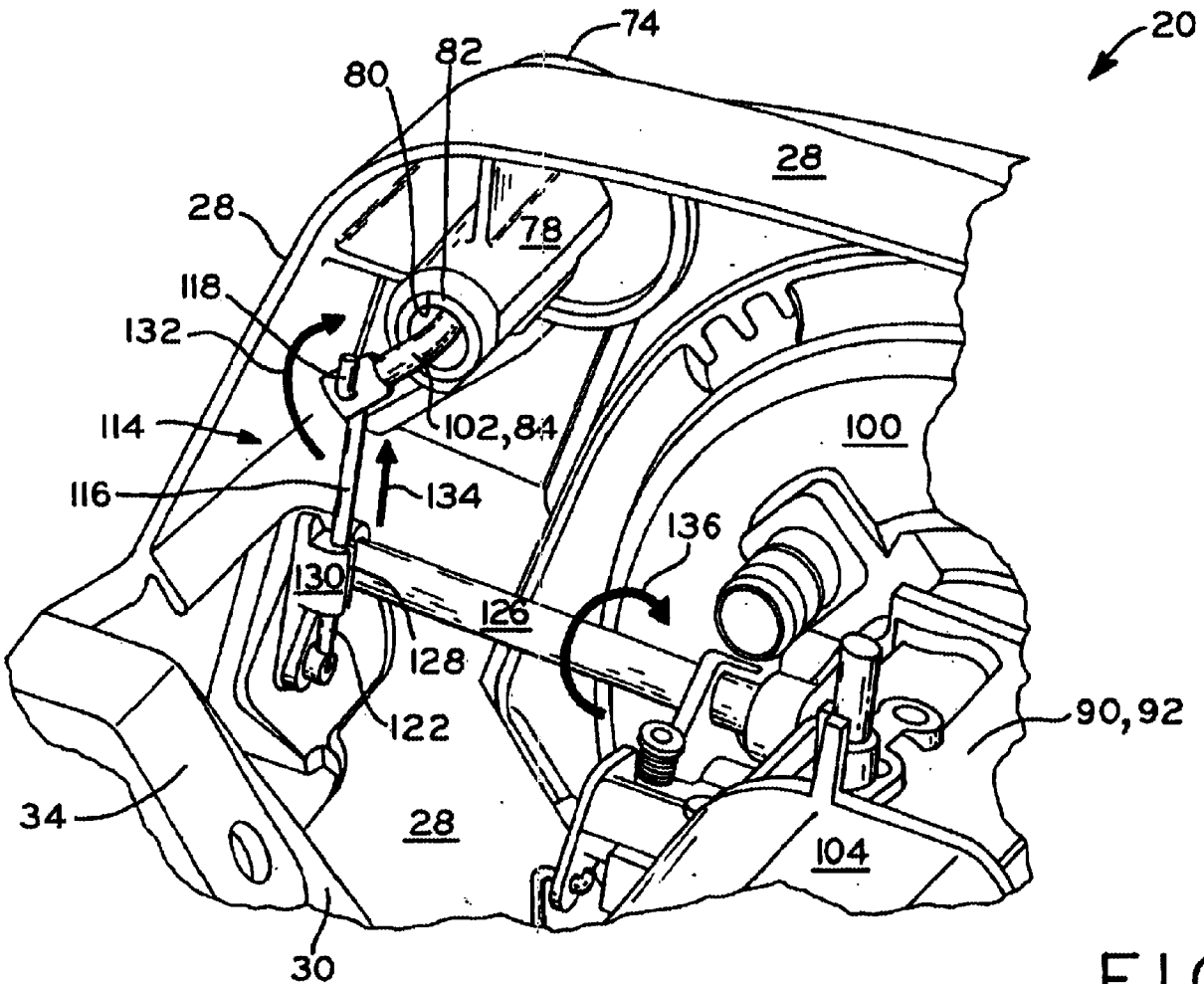
FIG. 7 is a second perspective view of an upper rear portion of the engine, showing the first linkage set corresponding to the carburetor choke control member.
Figure 8:
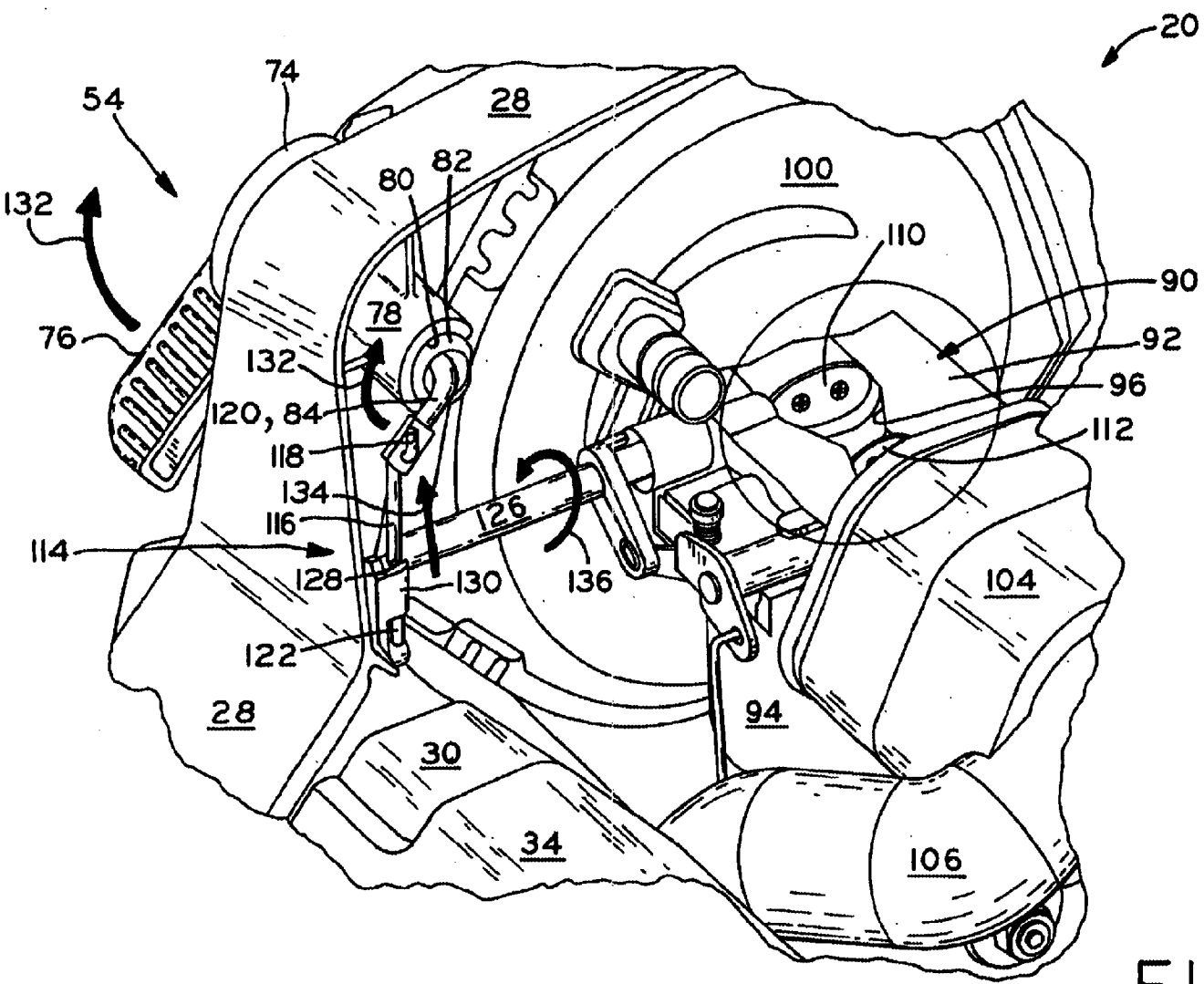
FIG. 8 is a third perspective view of an upper rear portion of the engine, showing the first linkage set corresponding to the carburetor choke control member.

As shown in FIGS. 2, 6, and 8, carburetor choke control 54 and carburetor throttle control 56 each include knob portions 74 rotatably mounted within shroud 28 as described below, and handle portions 76 projecting from knob portions 74, which are sized for easy grasping by a user to rotate choke and throttle controls 54 and 56. Referring to FIGS. 6–9, shroud 28 includes a pair of bosses 78 integrally formed therewith, which include bores 80 in which cylindrical bushings 82 are carried. Rotatably supported within bushings 82 are control shafts 84 which are connected to choke and throttle controls 54 and 56 for rotation therewith.

Figure 9:
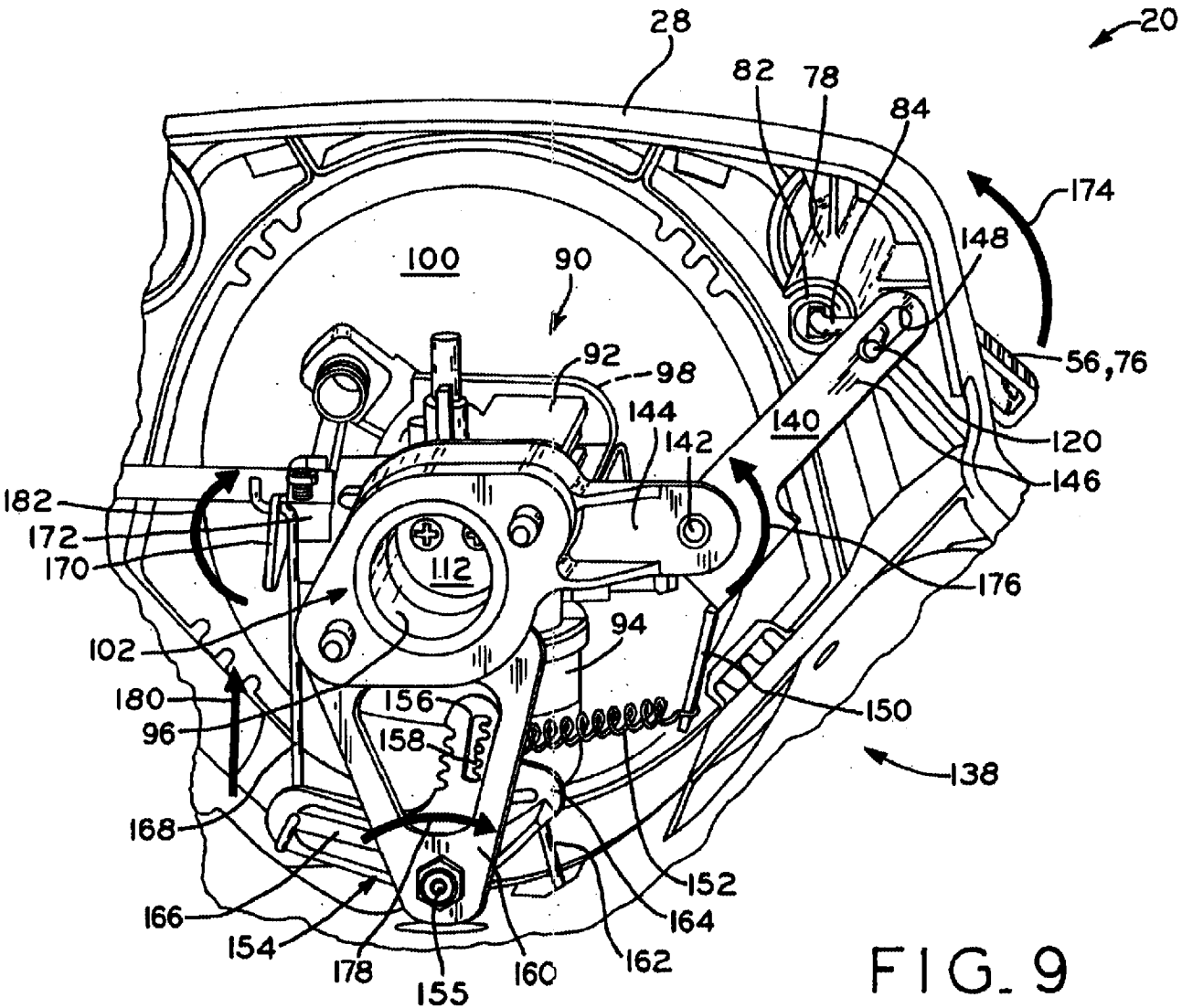
FIG. 9 is a fourth perspective view of an upper rear portion of the engine, showing the second linkage set corresponding to the carburetor throttle control member.

As shown in FIGS. 8 and 9, carburetor 90 includes carburetor body 92 and fuel bowl 94, with carburetor body 92 including throat 96 therein. Inlet end 98 of carburetor body 92 is mounted to air cleaner cavity 100 of shroud 28, and outlet end 102 of carburetor body 92 is mounted to intake manifold 104. Intake manifold 104 includes a pair of intake pipes 106 connected to intake ports 108 of cylinders 24. As shown in the partially cut-away portion of carburetor 90 within the encircled area of FIG. 8, choke valve 110 (FIG. 8) and throttle valve 112 (FIGS. 8 and 9) are each rotatably mounted within carburetor throat 96.

Referring to FIGS. 7 and 8, a first linkage set 114 for operably connecting choke control 54 to choke valve 110 of carburetor 90 will now be described. First linkage set 114 includes rod 116 having an upper end 118 connected to bent end 120 of control shaft 84 of choke control 54, and an opposite lower end 122 connected to plate 124 of choke valve shaft 126. Rod 116 is slidably supported within groove 128 of bracket 130, which is mounted to shroud 28. Choke valve shaft 126 is rotatably carried within body 92 of carburetor 90, and choke valve 110 is mounted to an end of choke valve shaft 126 for rotation with choke valve shaft 126 within throat 96 of carburetor 90.

In operation, when choke control 54 is rotated along arrow 132, bent end 120 of control shaft 84 also rotates along arrow 132, and rod 116 translates upwardly along arrow 134, thereby rotating plate 124 and choke valve shaft 126 along arrow 136 to concurrently rotate choke valve 110 within throat 96 of carburetor. In this manner, a user may selectively open and close choke valve 110 of carburetor 90 as necessary by rotating choke control 54 in opposite directions.

Referring to FIG. 9, a second linkage set 138 for operably connecting throttle control 56 to throttle valve 112 of carburetor 90 will now be described. Second linkage set 138 includes lever 140 pivotally mounted at pivot 142 to support strut 144 of carburetor 90. Lever 140 includes upper end 146 having slot 148 in which bent end 120 of control shaft 84 of throttle control 56 is received. Lever 140 includes lower end 150 to which an end of spring 152 is connected, with an opposite end of spring 152 connected to throttle/governor lever 154. First end portion 156 of throttle/governor lever 154, to which spring 152 is connected, includes a plurality of slots 158 for adjustable connection of spring 152 to thereby vary the actuation of second linkage set 138. Throttle/governor lever 154 is mounted at pivot 155 to support strut 160 of carburetor 90. Governor link 162 is mounted to second end portion 164 of throttle/governor lever 154 to allow the governor (not shown) of engine 20 to regulate the actuation of throttle valve 112 of carburetor 90 in response to loads placed upon engine 20 during running thereof. Third end portion 166 of throttle/governor lever 154 is connected to a lower end of rod 168, and an opposite, upper end of rod 168 is connected to plate 170 and throttle shaft 172.

In operation, when throttle control 56 is rotated about arrow 174, bent end 120 of control shaft 84 rotationally translates within slot 148 of lever 140, thereby rotating lever 140 at pivot 142 along arrow 176. Rotation of lever 140 translates and stretches spring 152, and rotates throttle/governor lever 154 at pivot 155 about arrow 178, in turn translating rod 168 upwardly along arrow 180 and rotating plate 170 and throttle shaft 172 about arrow 182 to thereby rotate throttle valve 112 within throat 96 of carburetor 90. In this manner, throttle valve 112 may be moved between open and closed positions to regulate the amount of air/fuel mixture which is supplied to engine 20 through carburetor 90.

An alternate control embodiment (not shown) may include a third linkage set operably connecting a single choke/throttle control member to choke valve 110 and to throttle valve 112 of carburetor 90.

First and second linkage sets 114 and 138 are substantially covered from the front of engine 20 by shroud 28, and are substantially covered from the top of engine 20 by fuel tank 32. In this manner, first and second linkage sets 114 and 138 are substantially hidden from view by shroud 28 and fuel tank 32, and are also thereby protected from incidental contact and damage.

Referring to FIG. 6, first fuel conduit 182 is connected between the outlet of fuel tank 32 (not shown in FIG. 6) to communicate same with inlet 184 of fuel shut-off valve 64. Second fuel conduit 188 is connected between outlet 186 of fuel shut-off valve 64 and fuel inlet 190 of carburetor 90. When fuel shut-off valve 64 is open, inlet 184 and outlet 186 of fuel shut-off valve 64 are in fluid communication with one another, thereby allowing fuel to flow from fuel tank 32 through first fuel conduit 182, fuel shut-off valve 64, and second fuel conduit 188 into fuel bowl 94 of carburetor 90. Carburetor 90 includes a float valve (not shown) therein to meter the supply of fuel into fuel bowl 94. When fuel shut-off valve 64 is closed, inlet 184 and outlet 186 of fuel shut-off valve 64 are blocked from communication with one another such that fuel flow from fuel tank 32 to carburetor 90 is blocked. Referring to FIGS. 1, 2, 4, and 5, fuel shut-off valve 64 is positioned within first quadrant 46 of engine 20. More specifically, as best shown in FIGS. 1, 2, and 4, fuel shut-off valve 64 is positioned within a space above the upper left portion of shroud 28 beneath the bottom surface of fuel tank 32, and closely adjacent oil fill cap 70, ignition key switch 60, and throttle 56. Fuel shut-off valve 64 is held in position by first and second fuel conduits 182, 188, respectively, which are somewhat inflexible. Alternatively, fuel shut-off valve 64 may be mounted to shroud 28 by a suitable bracket (not shown) to thereby fix the position of fuel shut-off valve 64 with respect to shroud 28.

Referring to FIGS. 1, 2, 4, and 5, ignition key switch 60 is mounted within knock-out opening 192*a* in shroud 28.

Ignition key switch 60 is operatively connected to the ignition system of engine 20 such that the ignition system is enabled when key 62 is inserted into ignition key switch 60. When key 62 is removed from ignition key switch 60, the ignition circuit of the ignition system of engine 20 is broken such that engine 20 cannot be operated. Shroud 28 includes a second knock-out 192*b* positioned on the right side of shroud 28 opposite first knock-out opening 192*b*. Second knock-out 192*b* may be removed to provide an opening in which ignition key switch 60 may mounted, thereby allowing ignition key switch 60 to be alternatively positioned on the right side of shroud 28 if desired. Referring to FIGS. 1 and 2, it may be seen that ignition key switch 60 is shown positioned within upper front quadrant 46 of engine 20, closely proximate throttle control 56, fuel shut-off valve 64, and oil fill cap 70.

Referring to FIGS. 1–5, carburetor primer bulb 58 is positioned within upper front quadrant 46 of engine 20, and more specifically, within an upper central portion of shroud 28 between throttle control 54 and choke control 56. Carburetor primer bulb 58 is made of a flexible material such as rubber, for example, and is connected to fuel bowl 94 of carburetor 90. Primer bulb 58 includes vent 194 centrally disposed therein. When a user places a finger over vent 194 and depresses carburetor primer bulb 58, a charge of air is forced from the interior of primer bulb 58 into fuel bowl 94 of carburetor 90, thereby pressurizing the head space in fuel bowl 94 to force a quantity of priming fuel into throat 96 of carburetor 90 to aid in starting engine 20.

Fuel tank cap 66 is threadably secured to the filler neck (not visible) of fuel tank 32, and may be removed to allow fuel to be filled into fuel tank 32. As shown in FIGS. 1–5, fuel tank cap 66 is positioned within upper front quadrant 46 of engine 20, and more specifically, at the front left corner of fuel tank 32 and closely proximate throttle control 56 and fuel shut-off valve 64. Optionally, fuel tank 32 may be reconfigured such that fuel tank cap 66 and filler neck 68 are positioned at the front right corner of fuel tank 32, with fuel tank cap 66 positioned closely proximate choke control 54.

Oil fill cap 70 is attached to the inlet of oil fill conduit 72 in a suitable manner, and may be removed to allow oil to be filled through oil fill conduit 72 into crankcase 22 of engine 20. Oil fill conduit 72 projects through opening 196 (FIG. 4) in shroud 28. As may be seen from FIGS. 1–5, oil fill conduit 72 is positioned within upper front quadrant 46 of engine 20, and more specifically, is positioned closely proximate fuel shut-off valve 64, fuel tank cap 66, throttle control 56, and ignition key switch 60. Alternatively, oil fill conduit 72 may be located on the right side of shroud 28 if desired, such that oil fill conduit 72 and oil fill cap 70 are positioned closely proximately choke control 54.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In an internal combustion engine having a substantially horizontally disposed crankshaft, said engine conceptually divided by intersecting horizontal and vertical planes into four quadrants, including an upper front quadrant, a lower front quadrant, an upper rear quadrant, and a lower rear quadrant, said engine comprising:

at least five user interfaces positioned substantially within said upper front quadrant.

2. The internal combustion engine of claim 1, wherein said user interfaces comprise at least three of the following:

a carburetor throttle control;

a carburetor choke control;

a carburetor primer bulb;

an ignition switch;

a fuel shut-off valve;

a fuel fill inlet; and an oil fill inlet.

3. The internal combustion engine of claim 1, wherein said engine includes at least six said user interfaces positioned substantially within said upper front quadrant.

4. The internal combustion engine of claim 1, including a carburetor throttle control and a carburetor choke control positioned substantially within said upper front quadrant.

5. The internal combustion engine of claim 1, wherein said engine includes two cylinders.

6. An internal combustion engine, comprising:

an engine housing including a crankcase;

a crankshaft rotatably supported within said crankcase;

a shroud connected to said engine housing, said shroud having a distal region which is spaced away from said crankshaft; and at least five user interfaces concentrated about said distal shroud region.

7. The internal combustion engine of claim 6, wherein said user interfaces comprise at least three of the following:

a carburetor throttle control;

a carburetor choke control;

a carburetor primer bulb;

an ignition switch;

a fuel shut-off valve;

a fuel fill inlet; and an oil fill inlet.

8. The internal combustion engine of claim 6, wherein said engine includes at least six said user interfaces concentrated about said distal shroud region.

9. The internal combustion engine of claim 6, including a carburetor throttle control and a carburetor choke control concentrated about said distal shroud region.

10. The internal combustion engine of claim 6, wherein said engine includes two cylinders.

11. An internal combustion engine, comprising:

an engine housing including a crankcase;

a crankshaft rotatably supported within said crankcase, said crankshaft disposed substantially horizontally;

a shroud connected to said engine housing; and at least one control member rotatably mounted within said shroud, said control member operatively connected to an air/fuel mixing device; and at least one of a fuel fill inlet and an oil fill inlet located proximate said at least one control member.

12. The internal combustion engine of claim 11, wherein said shroud includes an upper portion spaced away from said crankshaft, and said at least one control member is rotatably mounted within said shroud upper portion.

13. The internal combustion engine of claim 11, wherein said air/fuel mixing device comprises a carburetor having a throttle valve and a choke valve.

14. The internal combustion engine of claim 13, wherein said engine includes a pair of said control members, one said control member operatively connected via a first linkage set to said throttle valve and the other of said control members operatively connected via a second linkage set to said choke valve.

15. The internal combustion engine of claim 11, further comprising at least one additional engine control component mounted within said shroud proximate said at least one control member, said at least one additional engine control component selected from the group consisting of an ignition switch, a fuel shut-off switch, and a carburetor primer bulb.

16. The internal combustion engine of claim 11, further comprising two cylinders mounted to said crankcase.

17. An internal combustion engine, comprising:

an engine housing including a crankcase;

a crankshaft rotatably supported within said crankcase, said crankshaft disposed substantially horizontally;

a shroud connected to said engine housing, said shroud defining a control region in an upper portion of said shroud which is spaced from said crankshaft;

at least one engine control member rotatably mounted within said shroud in said control region; and at least five additional user interface components located proximate said control region of said shroud.

18. The internal combustion engine of claim 17, further comprising a carburetor having a throttle valve and a choke valve.

19. The internal combustion engine of of claim 18, wherein said engine includes a pair of said control members, one said control member operatively connected via a first linkage set to said throttle valve and the other of said control members operatively connected via a second linkage set to said choke valve.

20. The internal combustion engine of claim 17, wherein said at least one additional user interface component comprises one of the following:

a carburetor primer bulb;

an ignition switch;

a fuel shut-off valve;

a fuel fill inlet; and an oil fill inlet.

21. The internal combustion engine of claim 17, further comprising two cylinders connected to said crankcase.

* * * * *

UNITED STATES PATENT AND TRADEMARK OFFICE

CERTIFICATE OF CORRECTION

PATENT NO. : 6,857,410 B2
DATED : February 22, 2005
INVENTOR(S) : Steven T. Davis et al.

It is certified that error appears in the above-identified patent and that said Letters Patent is hereby corrected as shown below:

Title page,
Item [73], Assignee, insert -- Tecumseh Products Company, Tecumseh, Michigan --.

Signed and Sealed this

Sixteenth Day of August, 2005

JON W. DUDAS
*Director of the United States Patent and Trademark Office*